US012446628B2

(12) United States Patent
Yang et al.

(10) Patent No.: US 12,446,628 B2
(45) Date of Patent: Oct. 21, 2025

(54) ELECTRONIC VAPORIZATION DEVICE AND VAPORIZER

(71) Applicant: Jiangmen Smoore New Material Co., Ltd., Guangdong (CN)

(72) Inventors: Xingxing Yang, Jiangmen (CN); Guanghui Li, Jiangmen (CN); Hu Jin, Jiangmen (CN)

(73) Assignee: Jiangmen Smoore New Material Co., Ltd., Jiangmen (CN)

( * ) Notice: Subject to any disclaimer, the term of this patent is extended or adjusted under 35 U.S.C. 154(b) by 334 days.

(21) Appl. No.: 18/324,399

(22) Filed: May 26, 2023

(65) Prior Publication Data

US 2023/0380506 A1 Nov. 30, 2023

(30) Foreign Application Priority Data

May 30, 2022 (CN) ..... 202221343661.0

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 40/46*** | (2020.01) |

(52) U.S. Cl.

CPC ..... *A24F 40/485* (2020.01); *A24F 40/10* (2020.01); *A24F 40/42* (2020.01); *A24F 40/46* (2020.01)

(58) Field of Classification Search

None

See application file for complete search history.

(56) References Cited

U.S. PATENT DOCUMENTS

| | | | |
|---|---|---|---|
| 2016/0249683 | A1 | 9/2016 | Li et al. |
| 2016/0262455 | A1 | 9/2016 | Chen |

FOREIGN PATENT DOCUMENTS

| | | | |
|---|---|---|---|
| CN | 105795525 | A | 7/2016 |
| CN | 210382626 | U | 4/2020 |
| CN | 215775552 | U | 2/2022 |
| CN | 216088829 | U | 3/2022 |

OTHER PUBLICATIONS

European Patent Office, Search Report in European Patent Application No. 23176166.9 (Nov. 6, 2023).

*Primary Examiner* — Phu H Nguyen

(74) *Attorney, Agent, or Firm* — Leydig, Voit & Mayer, Ltd.

(57) ABSTRACT

A vaporizer includes: a vaporization base; a rotary support; and a heating structure. The rotary support is located in the vaporization base and rotatable relative to the vaporization base. The vaporization base has a first liquid flowing hole and a first air outlet hole. The rotary support has a vaporization cavity and a second liquid flowing hole, a first air inlet hole, and a second air outlet hole that are all in communication with the vaporization cavity. The heating structure is fixed in the vaporization cavity. When the rotary support is located in a first orientation relative to the vaporization base, the first liquid flowing hole is in communication with the second liquid flowing hole to form a liquid flowing channel, the first air inlet hole is in communication with an outside, and the first air outlet hole is in communication with the second air outlet hole.

13 Claims, 17 Drawing Sheets

ELECTRONIC VAPORIZATION DEVICE AND VAPORIZER

CROSS-REFERENCE TO PRIOR APPLICATION

Priority is claimed to Chinese Patent Application No. 202221343661.0, filed on May 30, 2022, the entire disclosure of which is hereby incorporated by reference herein.

FIELD

The utility model relates to the field of vaporization, and more specifically, to an electronic vaporization device and a vaporizer.

BACKGROUND

In electronic vaporization devices in the related art, usually, a liquid vaporizable medium directly flows into a heating structure and is heated and vaporized by a heating wire or a heating film on the heating structure. Some electronic vaporization devices adopt a liquid vaporizable medium and a heating structure separately, and when in use, the heating structure is pushed to open a liquid channel. However, after the vaporization devices adopting this arrangement is used, the liquid vaporizable medium and the heating structure can still come into contact with air during placement of a vaporization housing. As a result, the taste is affected as the liquid vaporizable medium absorbs moisture in air, and the risk of liquid leakage during placement is high.

SUMMARY

In an embodiment, the present invention provides a vaporizer, comprising: a vaporization base; a rotary support; and a heating structure, wherein the rotary support is located in the vaporization base and rotatable relative to the vaporization base, wherein the vaporization base has a first liquid flowing hole and a first air outlet hole, wherein the rotary support has a vaporization cavity and a second liquid flowing hole, a first air inlet hole, and a second air outlet hole that are all in communication with the vaporization cavity, wherein the heating structure is fixed in the vaporization cavity, wherein, when the rotary support is located in a first orientation relative to the vaporization base, the first liquid flowing hole is in communication with the second liquid flowing hole to form a liquid flowing channel, the first air inlet hole is in communication with an outside, and the first air outlet hole is in communication with the second air outlet hole to form an air outlet channel, and wherein, when the rotary support rotates to a second orientation relative to the vaporization base, the liquid flowing channel and the air outlet channel are both disconnected, and the first air inlet hole is closed.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
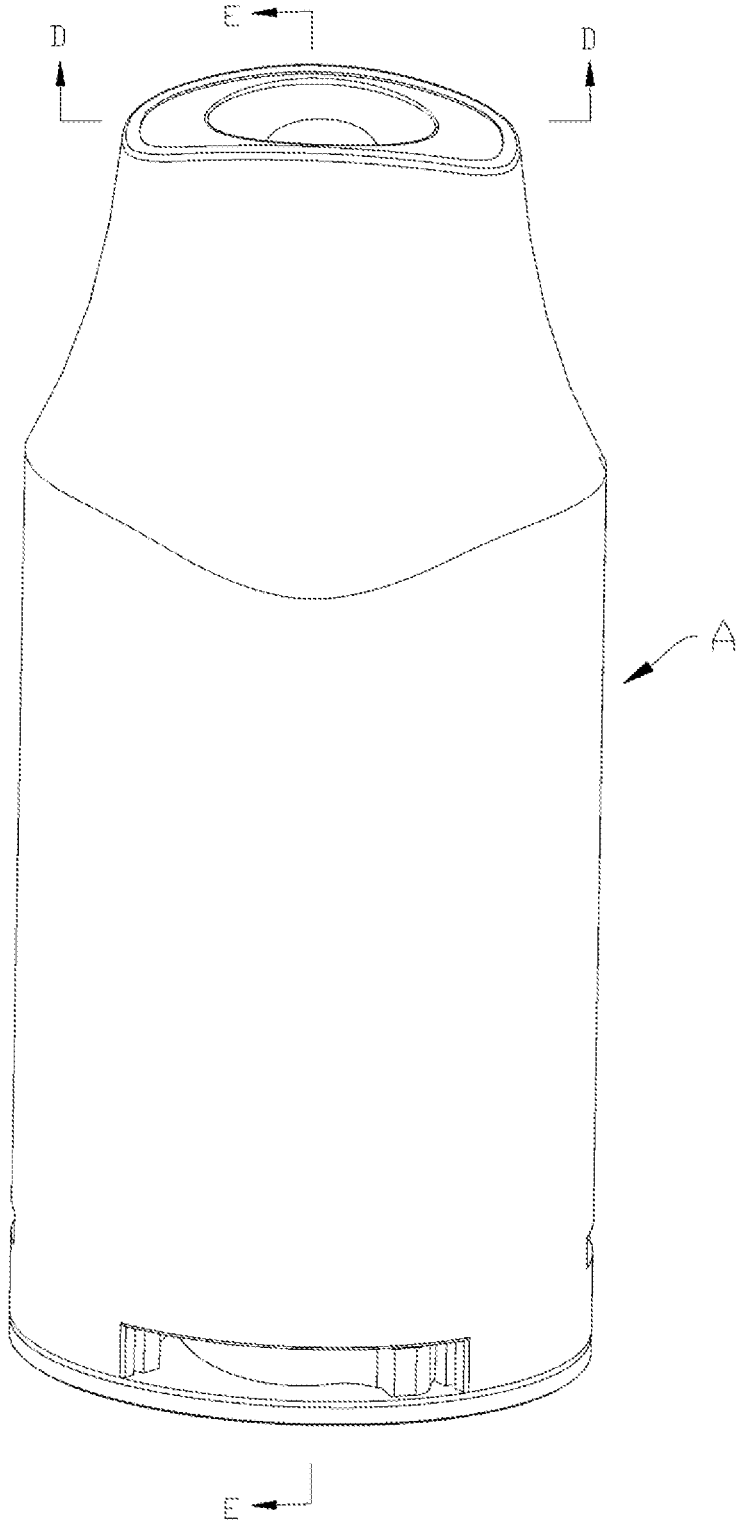
FIG. 1 is a schematic structural view of a vaporizer in an electronic vaporization device according to some embodiments of the utility model.

In an embodiment, the present invention provides an improved electronic vaporization device and vaporizer.

In an embodiment, the present invention provides a vaporizer, including:

a vaporization base, a rotary support, and a heating structure, where the rotary support is located in the vaporization base and rotatable relative to the vaporization base, the vaporization base is provided with a first liquid flowing hole and a first air outlet hole, the rotary support is provided with a vaporization cavity and a second liquid flowing hole, a first air inlet hole, and a second air outlet hole that are all in communication with the vaporization cavity, and the heating structure is fixed in the vaporization cavity;

when the rotary support is located in a first orientation relative to the vaporization base, the first liquid flowing hole is in communication with the second liquid flowing hole to form a liquid flowing channel, the first air inlet hole is in communication with the outside, and the first air outlet hole is in communication with the second air outlet hole to form an air outlet channel; and when the rotary support rotates to a second orientation relative to the vaporization base, the liquid flowing channel, the first air inlet channel, and the air outlet channel are all disconnected, and the first air inlet hole is closed.

In some embodiments, the rotary support includes a pull portion, and the pull portion penetrates through the vaporization base.

In some embodiments, the rotary support includes an upper base body and a lower base body, the upper base body is connected to the lower base body to form the vaporization cavity, and the lower base body includes the pull portion.

In some embodiments, the rotary support includes an upper base body and a lower base body, the upper base body is connected to the lower base body to form the vaporization cavity, the upper base body is provided with the second liquid flowing hole and the second air outlet hole, and the lower base body is provided with the first air inlet hole.

In some embodiments, the vaporizer further includes a seal structure located in the vaporization base, and the seal structure is sleeved on the rotary support and is provided with a third liquid flowing hole, a second air inlet hole, and a third air outlet hole; the seal structure is provided with the first air inlet channel, and the second air inlet hole is in communication with the outside through the first air inlet channel; and when the rotary support is located in the first orientation relative to the vaporization base, the first liquid flowing hole is in communication with the second liquid flowing hole through the third liquid flowing hole, the first air inlet hole is in communication with the first air inlet channel through the second air inlet hole, and the first air outlet hole is in communication with the second air outlet hole through the third air outlet hole.

In some embodiments, the vaporizer further includes a vaporization housing, the vaporization housing is sleeved on the vaporization base, a liquid storage cavity is formed between the vaporization housing and the vaporization base, and the liquid storage cavity is in communication with the first liquid flowing hole.

In some embodiments, the vaporization base is provided with a first vent hole in communication with the liquid storage cavity, the vaporization base is provided with a vent channel, one end of the vent channel is in communication with the first vent hole, and the other end is in communication with the first air inlet channel.

In some embodiments, the seal structure is provided with a second vent hole, and the second vent hole is in communication with the first air inlet channel and the vent channel.

In some embodiments, the rotary support includes an upper base body sleeved on the seal structure; and one end of the upper base body that is close to the first air outlet hole is provided with a seal surface, and when the rotary support rotates to the second orientation relative to the vaporization base, the seal surface closes the first air outlet hole.

In some embodiments, the end of the upper base body that is close to the first air outlet hole is provided with a sloping surface; and the sloping surface abuts the seal surface and slopes toward one side of the upper base body, and the second air outlet hole is provided on the sloping surface.

In some embodiments, a conductive member and a base are further included, where the conductive member is mounted in the rotary support, and one end is connected to the heating structure;

a mounting hole is provided on the rotary support, and the other end of the conductive member is mounted at the mounting hole;

the base is connected to the vaporization base, and a via hole is provided on the base;

when the rotary support is located in the first orientation relative to the vaporization base, the mounting hole is in communication with the via hole; and when the rotary support rotates to the second orientation relative to the vaporization base, the mounting hole is disconnected from the via hole.

In some embodiments, a vaporization housing is included, where a notch is provided on the side wall of the vaporization housing, an avoidance opening is provided on the vaporization base, and the notch is provided corresponding to the avoidance opening for the pull portion to penetrate through.

The utility model further constructs an electronic vaporization device including the vaporizer described in the utility model.

By implementing the electronic vaporization device and the vaporizer of the utility model, the following beneficial effects are achieved: In the vaporizer, when the rotary heating assembly rotates relative to the vaporization base to the first orientation, the first liquid flowing hole is in communication with the second liquid flowing hole to form the liquid flowing channel, the first air inlet hole is in communication with the outside, and the first air outlet hole is in communication with the second air outlet hole to form the air outlet channel, so that gas can easily enter the vaporization cavity and carry vapor formed after vaporization out for a user to inhale; and when the rotary heating assembly rotates to the second orientation, the liquid flowing channel, the first air inlet channel, and the air outlet channel are all disconnected, and the first air inlet hole is closed, thereby preventing a liquid vaporizable medium from absorbing moisture in air due to the heating structure coming into contact with air during placement or transportation of the vaporizer, to improve the taste of an aerosol formed by vaporizing the liquid vaporizable medium, and avoid leakage of the liquid vaporizable medium.

In order to have a clearer understanding of the technical features, objectives, and effects of the utility model, specific implementations of the utility model are now described in detail with reference to the accompanying drawings.

Figure 2:
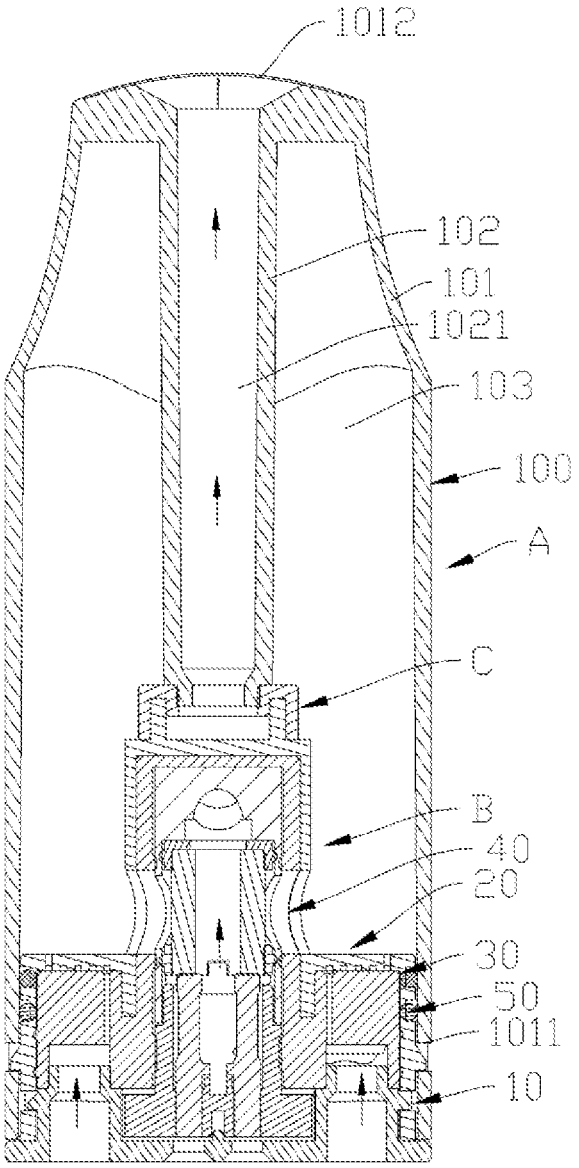
FIG. 2 is a D-D cross-sectional view of the vaporizer shown in FIG. 1.
Figure 3:
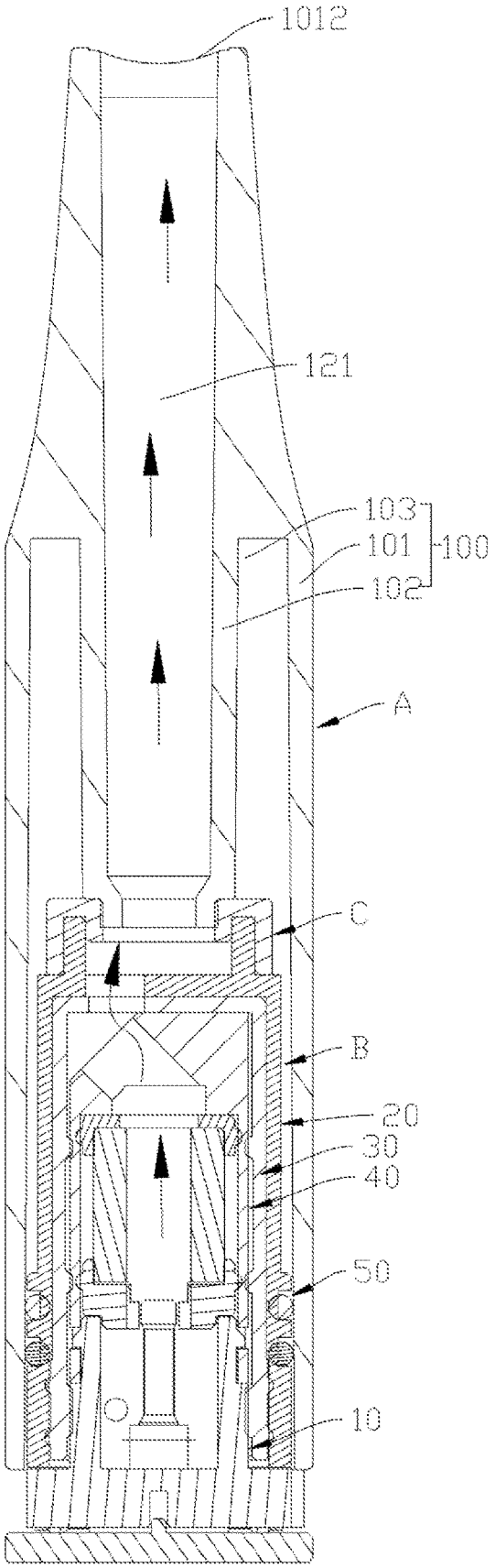
FIG. 3 is an E-E cross-sectional view of the vaporizer shown in FIG. 1.

FIG. 1 to FIG. 3 show some preferred embodiments of an electronic vaporization device of the utility model. The electronic vaporization device may be configured to heat and vaporize a liquid vaporizable medium to generate vapor for a user to inhale. In some embodiments, the electronic vaporization device has advantages of low liquid leakage and good vaporization taste.

In some embodiments, the electronic vaporization device includes a vaporizer and a power supply assembly. The vaporizer may be configured to vaporize a vaporizable medium, and the power supply assembly may be mechanically and electrically connected to the vaporizer, to supply power to the vaporizer.

As shown in FIG. 1 to FIG. 3, in some embodiments, the vaporizer includes a liquid storage unit A and a vaporization unit B. The liquid storage unit A may be configured to store the liquid vaporizable medium. The vaporization unit B is arranged in the liquid storage unit A, to vaporize the liquid vaporizable medium in the liquid storage unit A.

In some embodiments, the liquid storage unit A includes a vaporization housing 100. The vaporization housing 100 includes a shell 101 and an air outlet tube 102. The shell 101 is a cylindrical structure with a flat cross section. One end of the shell 101 is provided with an opening 1011, to assemble the vaporization unit B, and the other end is provided with a suction nozzle 1012 for a user to inhale the vapor. The air outlet tube 102 is arranged in the shell 101 and located at a central axis of the shell 101 with two ends penetrated. An airway 1021 may be formed in the inner side of the air outlet tube 102. In some embodiments, a liquid storage cavity 103 may be formed in the gap between the inner side wall of the shell 101 and the air outlet tube 102, to store the liquid vaporizable medium. The vaporization unit B may be accommodated in the vaporization housing 100, located on one end of the air outlet tube 102. In some embodiments, the vaporization housing 100 is provided with a notch 104, and the notch 104 is located at the opening 1011. Two notches 104 may be provided, and the two notches 104 are provided on two opposite side walls of the shell 101. The notch 104 may be provided longitudinally and may extend in the circumferential direction of the vaporization housing 100. Two ends of the notch 104 are provided corresponding to a first orientation and a second orientation.

Figure 4:
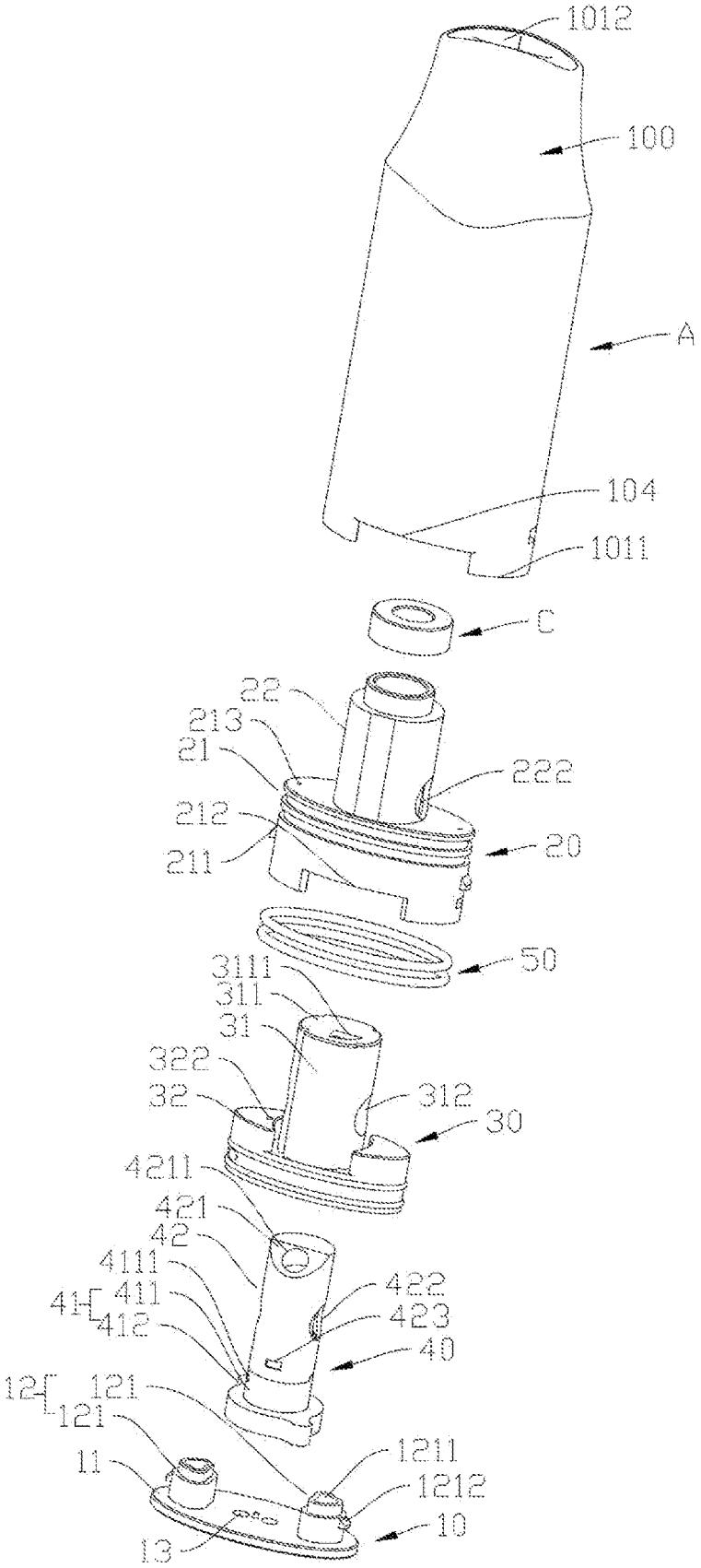
FIG. 4 is a schematic exploded view of the vaporizer shown in FIG. 1.

As shown in FIG. 4, in some embodiments, the vaporization unit B includes a base 10, a vaporization base 20, and a rotary heating assembly 40. In some embodiments, the base 10 is configured to assemble the vaporization based 20, and may be inserted in the vaporization housing 100 to block the opening 1011 on one end of the vaporization housing 100, and clamped with the vaporization housing 100. The vaporization housing 100 is sleeved on the vaporization base 20, and the liquid storage cavity 103 is formed between the vaporization housing 100 and the vaporization base 20. The vaporization base 20 is sleeved on the base 10, to accommodate the rotary heating assembly 40. In some embodiments, the rotary heating assembly 40 is rotatably arranged in the vaporization base 20. When in use, the rotary heating assembly 40 is rotated to the first orientation, so that gas and the liquid vaporizable medium can easily enter the rotary heating assembly 40, to output the vapor formed by vaporization by the rotary heating assembly 40. When not in use, the rotary heating assembly 40 is rotated to the second orientation, to prevent the gas and the liquid vaporizable medium from entering the rotary heating assembly 40.

Further, in some embodiments, the base 10 includes a bottom plate 11 and a support structure 12 arranged on the bottom plate 11. The cross-section size of the bottom plate 11 may be greater than the cross-section size of the vaporization housing 100. In some embodiments, the support structure 12 includes two air inlet columns 121. The two air inlet columns 121 are spaced on the bottom plate 11 and clamped with the vaporization base 20. In this embodiment, the air inlet column 121 is a hollow structure with two ends penetrated, and an air inlet through hole 1211 may be formed in the inner side for external gas to enter the vaporization unit B. In some embodiments, a buckle 1212 is arranged on the air inlet column 121, and the buckle 1212 may be configured to be clamped with the vaporization base 20. In some embodiments, the base 10 is provided with two via holes 13, the two via holes 13 may be spaced, and the via holes 13 may be provided in one-to-one correspondence to electrodes of the power supply assembly, to electrically connect the power supply assembly to the rotary heating assembly 40.

Figure 5:
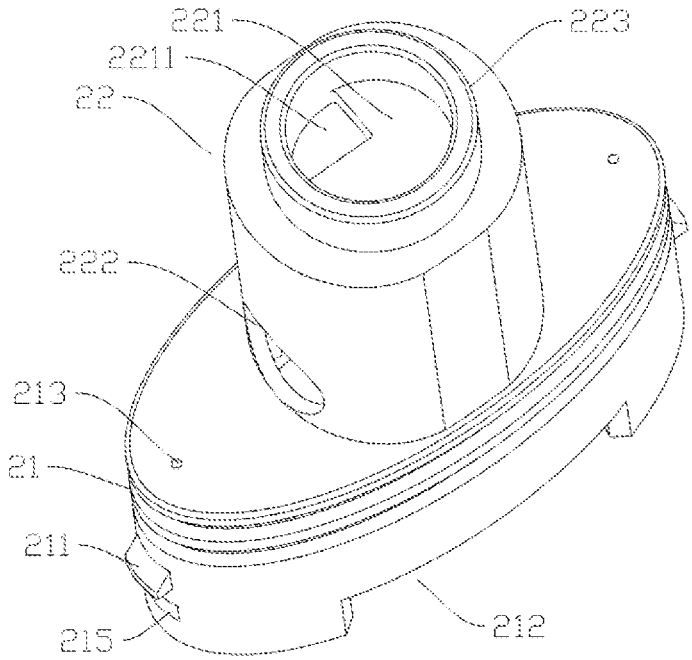
FIG. 5 is a schematic structural view of a vaporization base of the vaporizer shown in FIG. 4.
Figure 6:
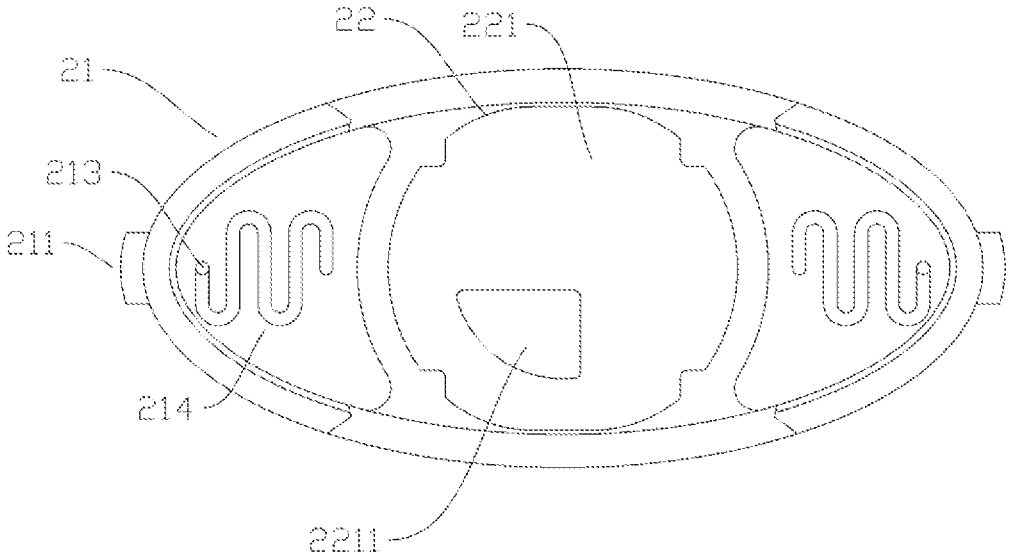
FIG. 6 is a schematic structural view of the vaporization base of the vaporizer shown in FIG. 5 from another angle of view.

As shown in FIG. 5 and FIG. 6, in some embodiments, the vaporization base 20 includes a base body 21 and a sleeve portion 22, and the base body 21 may be sleeved on the base 10 and clamped with the base 10. The sleeve portion 22 is in a columnar shape and is arranged on the base body 21. Specifically, the sleeve portion is located at a central axis of the base body 21 and may be sleeved on the periphery of the rotary heating assembly 40.

In some embodiments, the cross section of the base body 21 may be in a flat shape, and the base body 21 may be a cylindrical structure with one end provided with an assembly opening to assemble the base 10. A hook 211 is arranged on the base body 21, and the hook 211 may be clamped with the vaporization housing 10. The base body 21 is provided with an avoidance opening 212 near the assembly opening, and the avoidance opening 212 may be configured for a pull portion 412 of the rotary heating assembly 40 to penetrate through. In some embodiments, the avoidance opening 212 is provided in one-to-one correspondence to the notch 104 and is arranged longitudinally. The avoidance opening 212 extends in the circumferential direction of the vaporization housing 10, the length of the avoidance opening 212 matches the length of the notch 104, and two ends of the avoidance opening 212 are provided corresponding to the first orientation and the second orientation. In some embodiments, the vaporization base 20 is provided with a first vent hole 213. Specifically, the first vent hole 213 is provided on the top wall of the base body 21 and is in communication with the liquid storage cavity 103, to balance the pressure in the liquid storage cavity 103, so that the liquid vaporizable medium in the liquid storage cavity 103 can be outputted. In some embodiments, a vent channel 214 is arranged on the vaporization base 20, and the vent channel 214 is arranged on the inner side of the top wall of the base body 21, and has one end in communication with the first vent hole 213. In some embodiments, the vent channel 214 is a bent airway. In some embodiments, the base body 21 is provided with a buckle hole 215, and the buckle hole 215 is provided corresponding to the buckle 1212 on the air inlet column 121 to be clamped with the buckle 1212.

In some embodiments, the cross-section size of the sleeve portion 22 may be smaller than the cross-section size of the base body 21. In some embodiments, the cross section of the sleeve portion 22 may be substantially in a circular shape with a hollow structure.

One end of the sleeve portion 22 may abut the top wall of the base body 21. A retaining wall 221 is arranged on one end of the sleeve portion 22 that is away from the base body 21. The vaporization base 20 is provided with a first air outlet hole 2211. The first air outlet hole 2211 may be provided on the retaining wall 221, the size of the first air outlet hole 2211 may be smaller than the size of the retaining wall 221, and the first air outlet hole 2211 may be in a fan shape, so that the rotary heating assembly 40 can be rotated to be in communication with or dislocated from the first air outlet hole 2211. The first air outlet hole 2211 may be configured to output the vapor formed after vaporization. In some embodiments, the vaporization base 20 is provided with a first liquid flowing hole 222, and the first liquid flowing hole 222 is provided on the side wall of the sleeve portion 22. In some embodiments, two first liquid flowing holes 222 are provided, and the two first liquid flowing holes 222 are distributed on two opposite sides of the sleeve portion 22. The sleeve portion 22 may be arranged in the liquid storage cavity 103, and the first liquid flowing hole 222 may be in communication with the liquid storage cavity 103. In some embodiments, a bump 223 is provided on the retaining wall 221 of the sleeve portion 22, and the bump 223 may be configured to assemble the air outlet tube 102.

Figure 7:
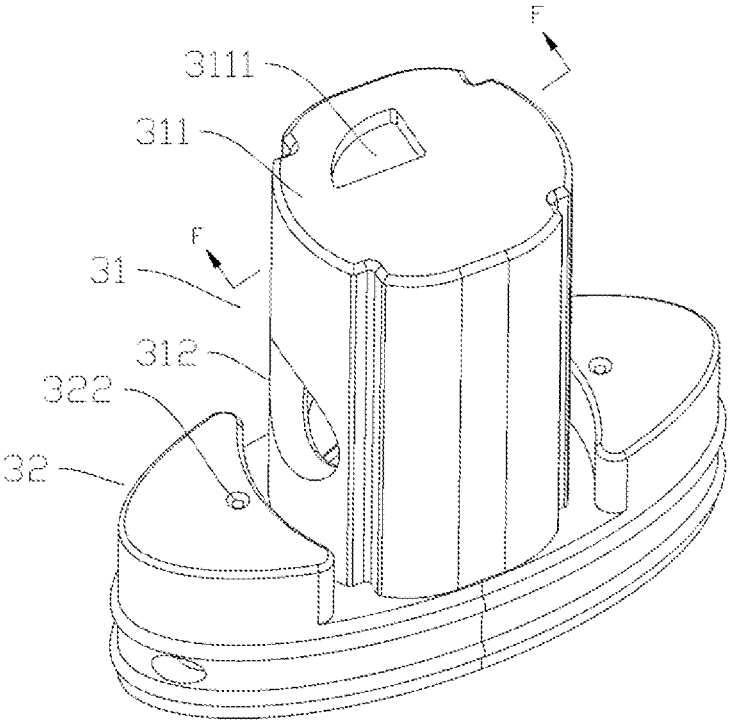
FIG. 7 is a schematic structural view of a seal structure of the vaporizer shown in FIG. 4.
Figure 8:
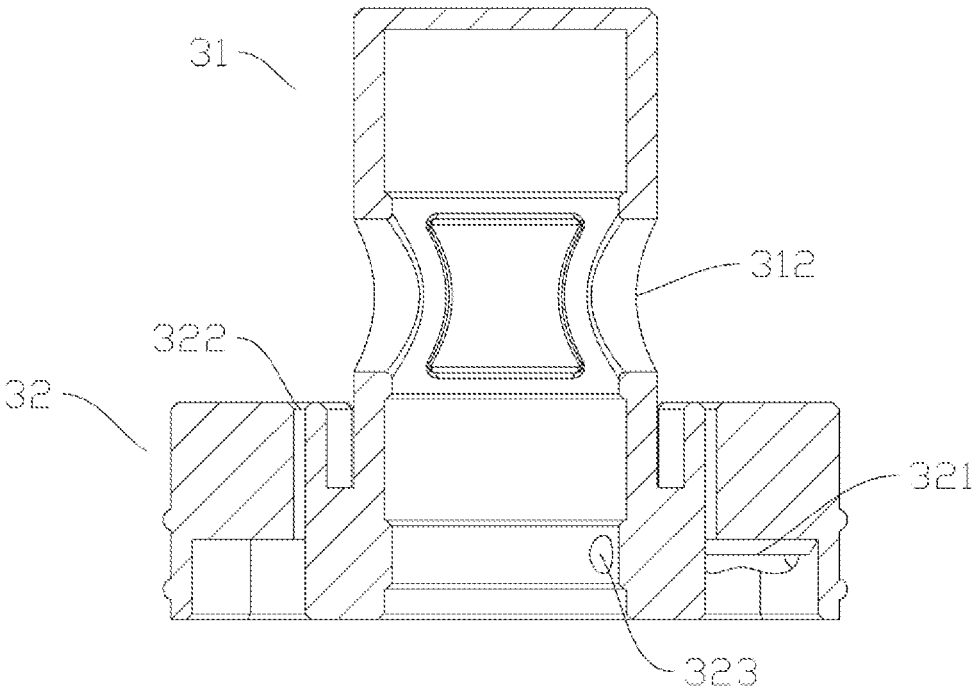
FIG. 8 is an F-F cross-sectional view of the seal structure of the vaporizer shown in FIG. 7.

As shown in FIG. 4, FIG. 7, and FIG. 8, in some embodiments, a seal structure 30 is arranged in the vaporization base 20. The seal structure 30 may be sleeved on the rotary heating assembly 40 and in an interference fit with the rotary heating assembly 40, and the seal structure 30 is located between the rotary heating assembly 40 and the vaporization base 20, to seal the gap between the vaporization base 20 and the rotary heating assembly 40. The rotary heating assembly 40 may be placed in the seal structure 30 to rotate. In some embodiments, the seal structure 30 may be a silica gel seal sleeve. Certainly, it may be understood that, in some other embodiments, the seal structure 30 may not be limited to the silica gel seal sleeve.

In some embodiments, the seal structure 30 includes a first sleeve body 31 and a second sleeve body 32. The first sleeve body 31 may be placed in the sleeve portion 22 and may be arranged corresponding to the sleeve portion 22. The second sleeve body 32 is placed on one end of the first sleeve body 31 and is arranged corresponding to the base body 21.

In some embodiments, the first sleeve body 31 may be in a columnar shape and may have a cross section substantially in a circular shape. An end wall 311 is arranged on one end of the first sleeve body 31 that is away from the base body 21, and the first sleeve body 31 is provided with a third air outlet hole 3111. The third air outlet hole 3111 may be provided on the end wall 311 and may have a cross-section size smaller than the cross-section size of the end wall 311. In some embodiments, the third air outlet hole 3111 may be in a fan shape and may be provided corresponding to the first air outlet hole 2211 and in communication with the first air outlet hole 2211. In some embodiments, the seal structure 30 may be provided with a third liquid flowing hole 312. Two third liquid flowing holes 312 may be provided, and the two third liquid flowing holes 312 may be provided on two opposite side walls of the first sleeve body 31 and be provided in one-to-one correspondence to the first liquid flowing holes 222 and in communication with the first liquid flowing holes 222.

In some embodiments, the shape and the size of the second sleeve body 32 may match the shape and the size of the base body 21. In some embodiments, the cross-section size of the first sleeve body 31 may be smaller than the cross-section size of the second sleeve body 32. The vaporizer includes a first air inlet channel 321. Specifically, the first air inlet channel 321 may be arranged on the seal structure 30, located on the inner side of the second sleeve body 32, and in communication with the air inlet column 121. In some embodiments, an insertion hole for inserting the air inlet column 121 is provided on the second sleeve body 32, and the first air inlet channel 321 is formed on the inner side of the insertion hole. The seal structure 30 may be provided with a second vent hole 322. The second vent hole 322 may be provided on the top wall of the second sleeve body 32 and in communication with the first air inlet channel 321 and the first vent hole 213. In some embodiments, the second vent hole 322 may be provided in one-to-one correspondence to the first vent hole 213. In some embodiments, the seal structure 30 may be provided with a second air inlet hole 323. The second air inlet hole 323 may be provided on the side wall of the second sleeve body 32 and in communication with the first air inlet channel 321.

Figure 9:
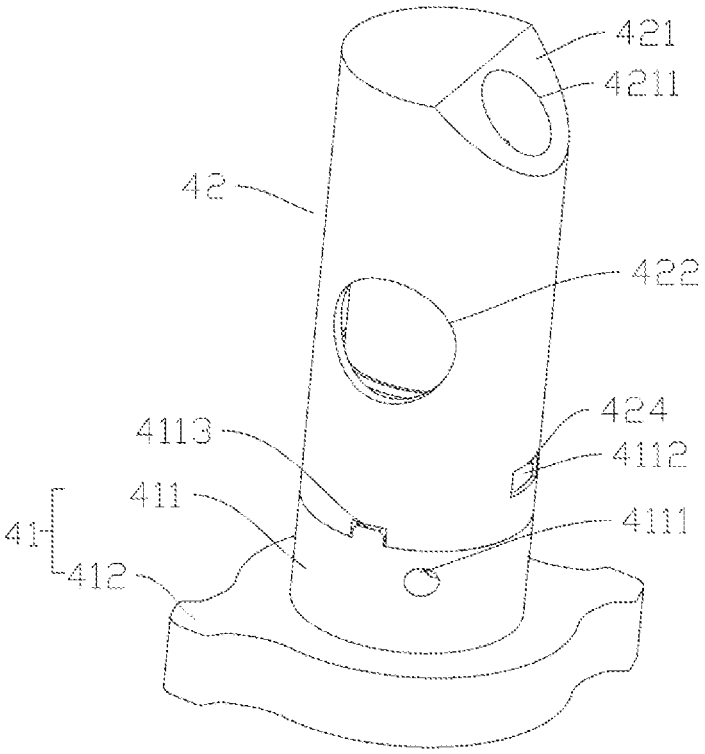
FIG. 9 is a schematic structural view of a rotary heating assembly of the vaporizer shown in FIG. 4.
Figure 10:
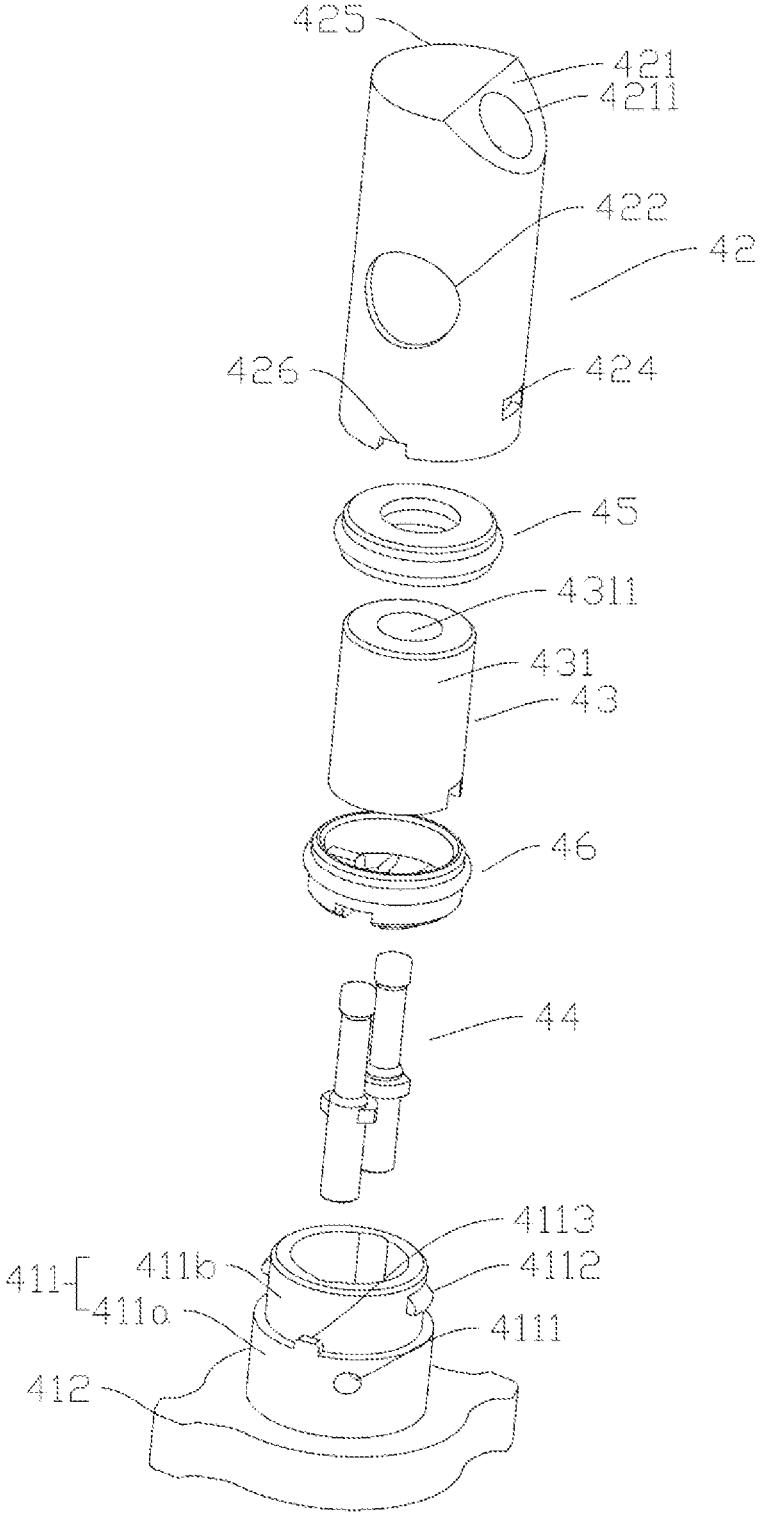
FIG. 10 is a schematic exploded structural view of the rotary heating assembly shown in FIG. 9.

As shown in FIG. 9 and FIG. 10, in some embodiments, the rotary heating assembly 40 includes a rotary support and a heating structure 43. The rotary support is located in the vaporization base 20 and rotatable relative to the vaporization base 20. The rotary support is provided with a vaporization cavity 420, and the heating structure 43 may be fixed in the vaporization cavity 420. In some embodiments, the rotary support is further provided with a second liquid flowing hole 422, a first air inlet hole 4111, and a second air outlet hole 4211. The second liquid flowing hole 422, the first air inlet hole 4111, and the second air outlet hole 4211 are all in communication with the vaporization cavity 420.

The rotary support includes a lower base body 41 and an upper base body 42. The lower base body 41 is configured to support the heating structure 43. The upper base body 42 is arranged on the lower base body 41 and is detachably connected to the lower base body 41 to form the vaporization cavity 420. In some embodiments, the upper base body 42 may be clamped with the lower base body 41, and the lower base body 41 upon rotating can drive the upper base body 42 to rotate together. It can be understood that, in some other embodiments, the upper base body 42 and the lower base body 41 may be integrally formed. The upper base body 42 may be sleeved on the periphery of the heating structure 43. The first sleeve body 31 may be sleeved on the upper base body 42 and in an interference fit with the upper base body 42. The second sleeve body 32 may be sleeved on the lower base body 41 and in an interference fit with the lower base body 41. In some embodiments, the heating structure 43 is configured to heat and vaporize a liquid vaporizable medium to generate vapor for a user to inhale.

Figure 11:
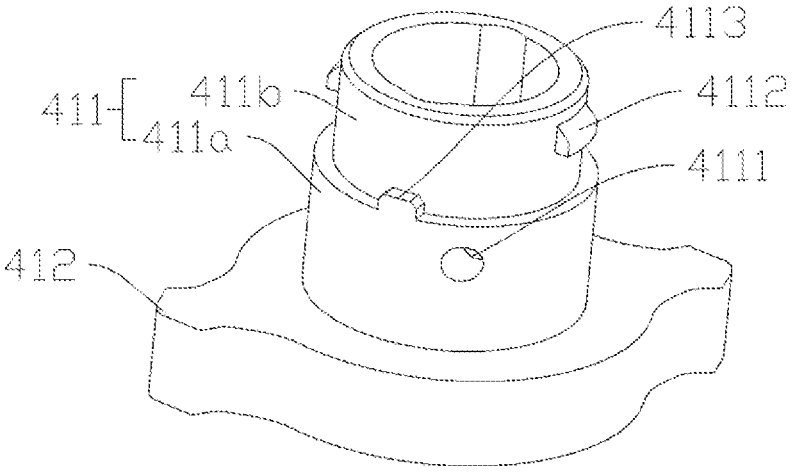
FIG. 11 is a schematic structural view of a lower base body of the rotary heating assembly shown in FIG. 4.

As shown in FIG. 11, in some embodiments, the lower base body 41 includes a support portion 411 and a pull portion 412. The support portion 411 may be in a cylindrical shape, to support the heating structure 43 and for a conductive member 44 to penetrate through. In some embodiments, the support portion 411 includes a body 411*a* and an engagement portion 411*b*. The body 411*a* and the engagement portion 411*b* are both in a cylindrical shape with a hollow structure. The engagement portion 411*b* may be arranged on one end of the body 411*a* and arranged coaxially with the body 411*a*, and the cross-section size of the engagement portion 411*b* may be smaller than the cross-section size of the body 411*a*, thereby forming a limiting step with the body 411*a*, to mount a limiter on the upper base body 42. In some embodiments, a limiting bump 4113 may be arranged on the body 411*a*, to mount a limiter on the upper base body 42. The upper base body 42 may be sleeved on the support portion 411. Specifically, the upper base body 422 may be sleeved on the engagement portion 411*b* and clamped with the engagement portion 411*b*. In some embodiments, the rotary heating assembly 40 includes a first air inlet hole 4111. The first air inlet hole 4111 may be provided on the side wall of the body 411*a* and penetrated in the thickness direction of the side wall, and the first air inlet hole 4111 may be in communication with the first air inlet channel 321 on the seal structure 30 for external gas to enter the vaporization cavity 420 of the rotary heating assembly 40. In some embodiments, a clamping bone 4112 is arranged on the engagement portion 411*b* and may be clamped with the upper base body 42. The pull portion 412 may be arranged on one end of the support portion 411 and arranged to extend toward the outside. In some embodiments, two pull portions 412 may be provided. The two pull portions 412 may be oppositely arranged on two opposite sides of the body 411*a* and arranged to extend toward the outside in the radial direction of the body 411*a*. Specifically, the pull portion 412 may penetrate through the avoidance opening 212 and the notch 104 and may slide in the notch 104 and the avoidance opening 212. By pulling the pull portion 412, the support portion 411 may be driven to rotate. In some embodiments, a mounting hole 413 is provided on the lower base body 41. Two mounting holes 413 may be provided and spaced on the bottom of the support portion 411, to mount the conductive member 44. In some embodiments, the mounting holes 413 are provided in one-to-one correspondence to the via holes 13.

Figure 12:
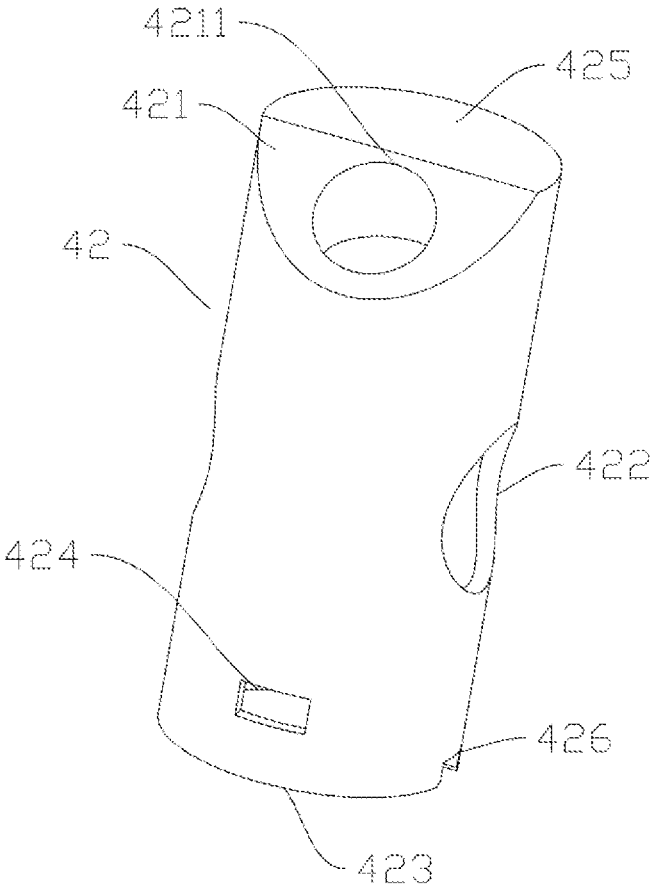
FIG. 12 is a schematic structural view of an upper base body of the rotary heating assembly shown in FIG. 4.
Figure 13:
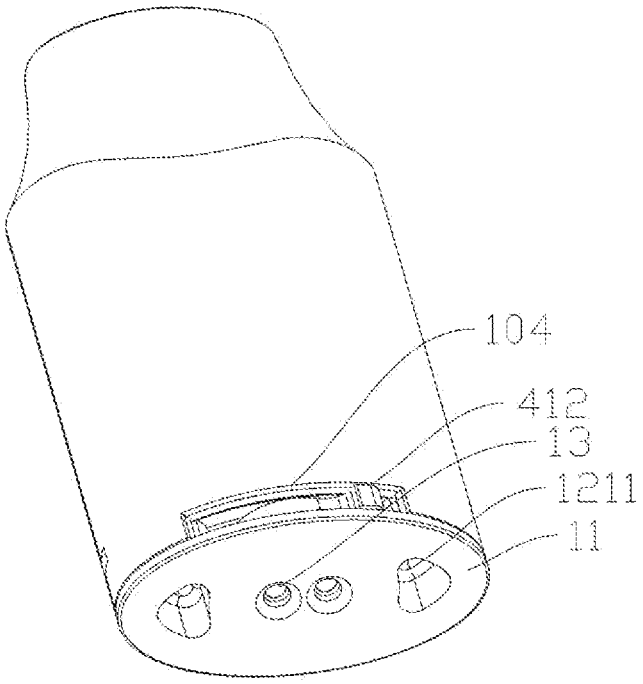
FIG. 13 is a schematic structural view of the vaporizer shown in FIG. 1 in a use state.
Figure 14:
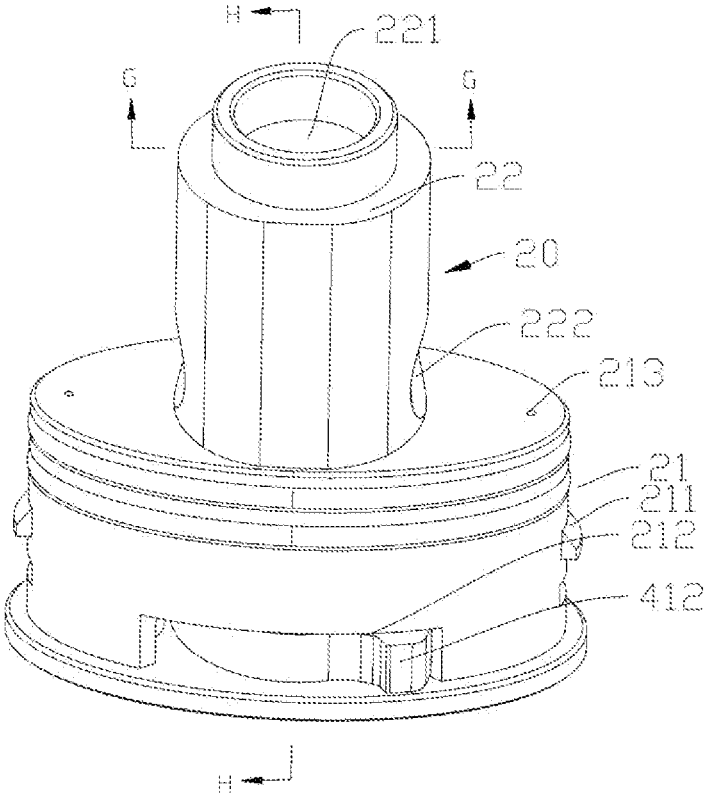
FIG. 14 is a schematic structural view of a vaporization unit in the vaporizer shown in FIG. 13 in a use state.
Figure 15:
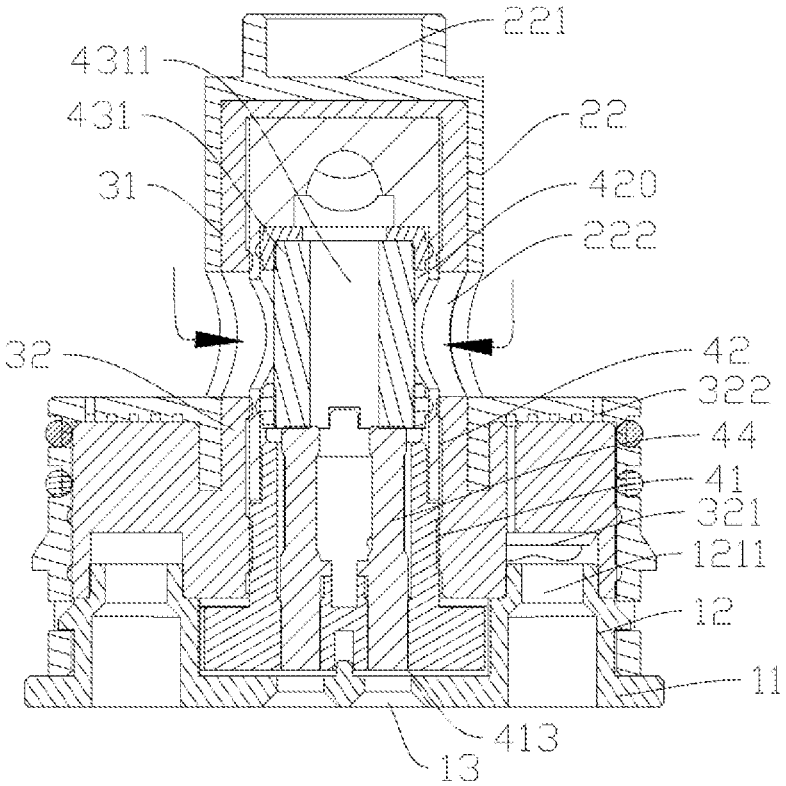
FIG. 15 is a G-G cross-sectional view of the vaporization unit shown in FIG. 14 in a use state.
Figure 16:
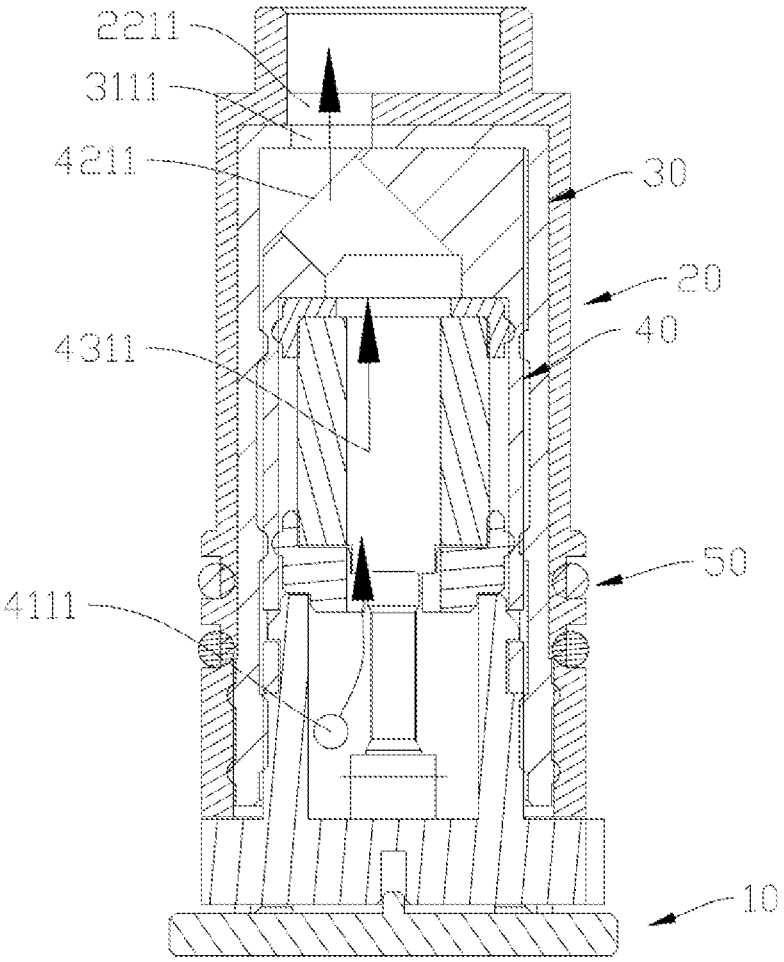
FIG. 16 is an H-H cross-sectional view of the vaporization unit shown in FIG. 14 in a use state.
Figure 17:
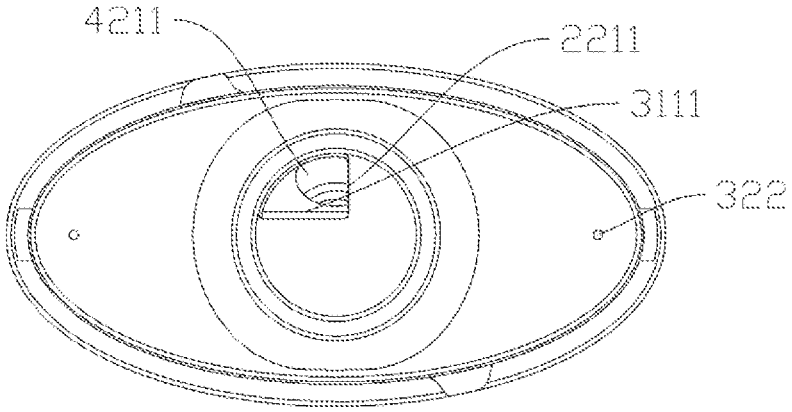
FIG. 17 is a schematic structural view the vaporization unit in the vaporizer shown in FIG. 14 in a use state from another angle of view.
Figure 18:
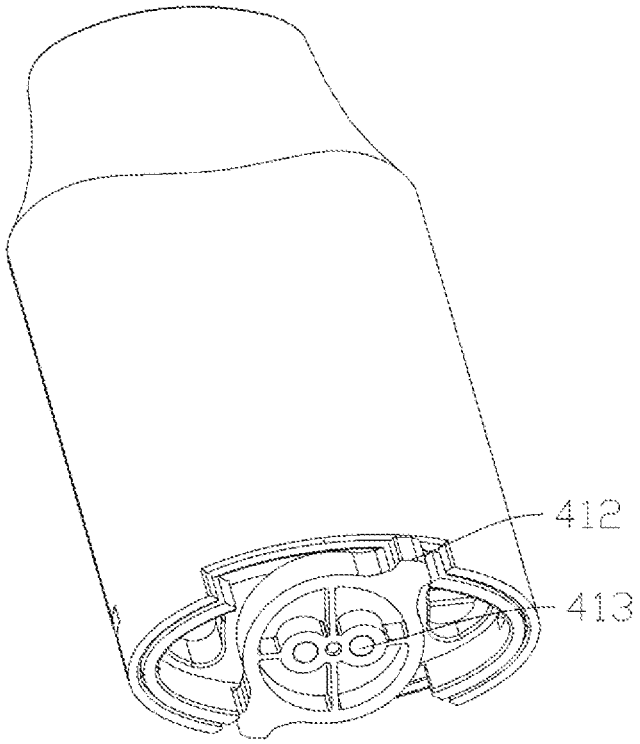
FIG. 18 is a schematic structural view from another perspective of the vaporizer shown in FIG. 13 in a use state.
Figure 19:
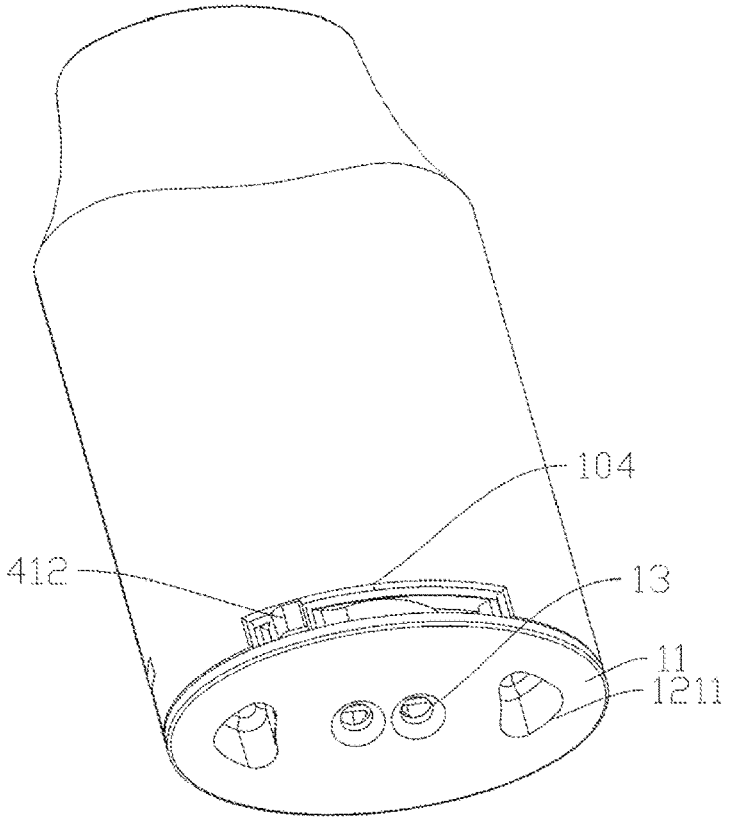
FIG. 19 is a schematic structural view of the vaporizer shown in FIG. 1 in a non-use state.
Figure 20:
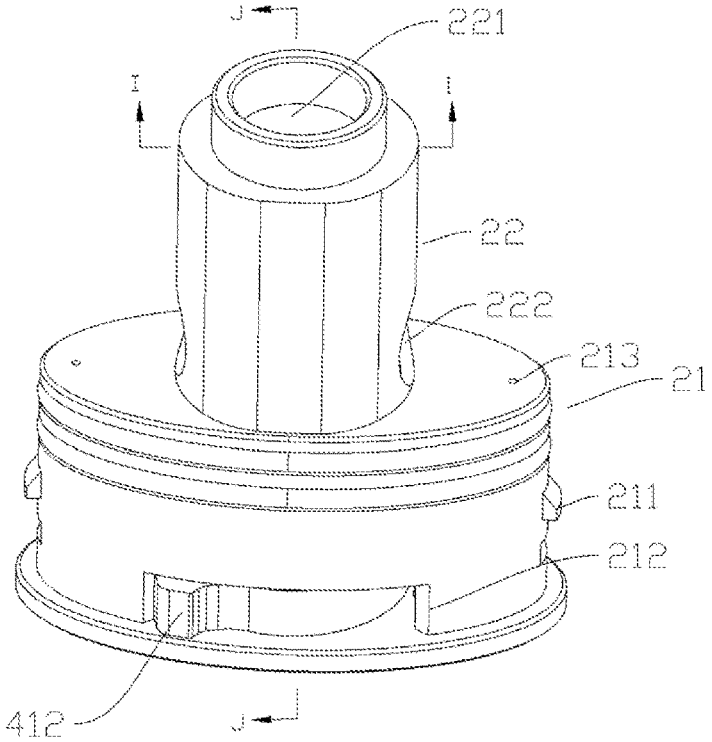
FIG. 20 is a schematic structural view of the vaporization unit in the vaporizer shown in FIG. 19 in a non-use state.
Figure 21:
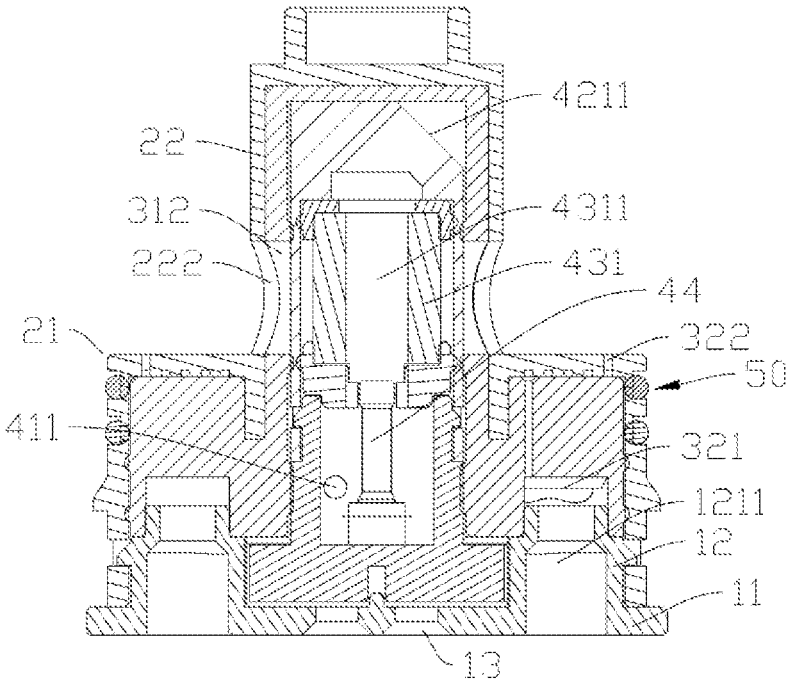
FIG. 21 is an I-I cross-sectional view of the vaporization unit in the vaporizer shown in FIG. 20 in a non-use state.
Figure 22:
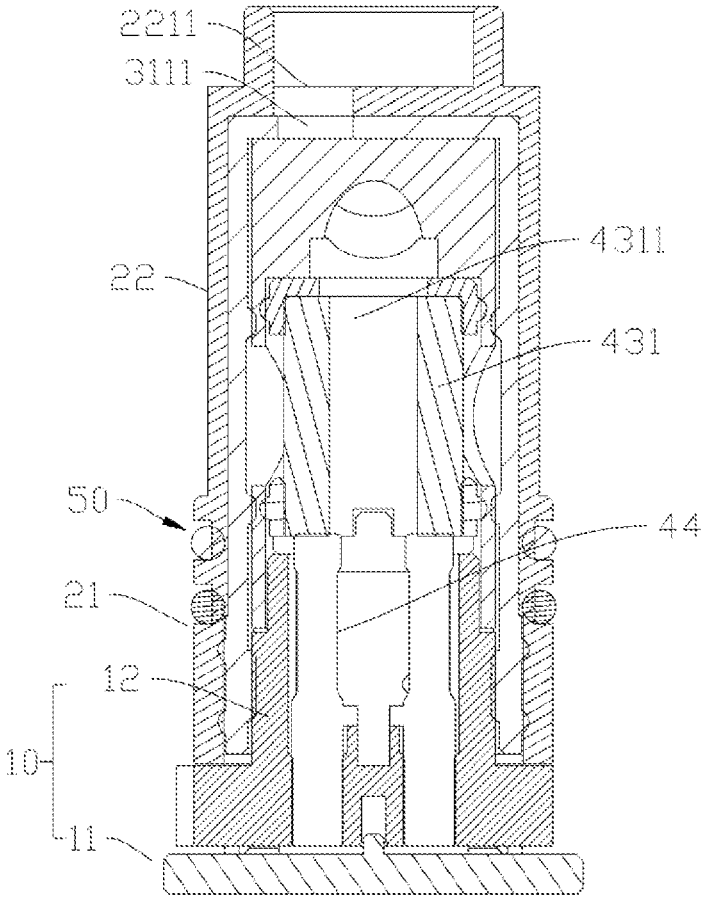
FIG. 22 is a J-J cross-sectional view of the vaporization unit in the vaporizer shown in FIG. 20 in a non-use state.
Figure 23:
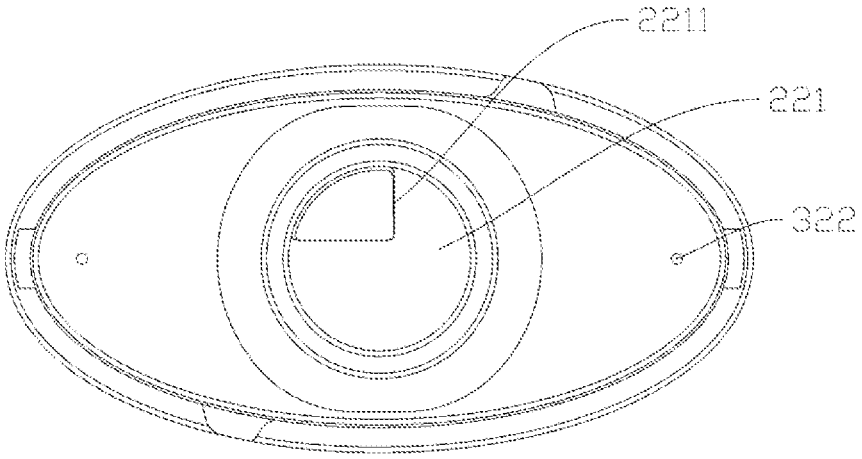
FIG. 23 is a schematic structural view of the vaporization unit in the vaporizer shown in FIG. 20 in a non-use state from another angle of view.
Figure 24:
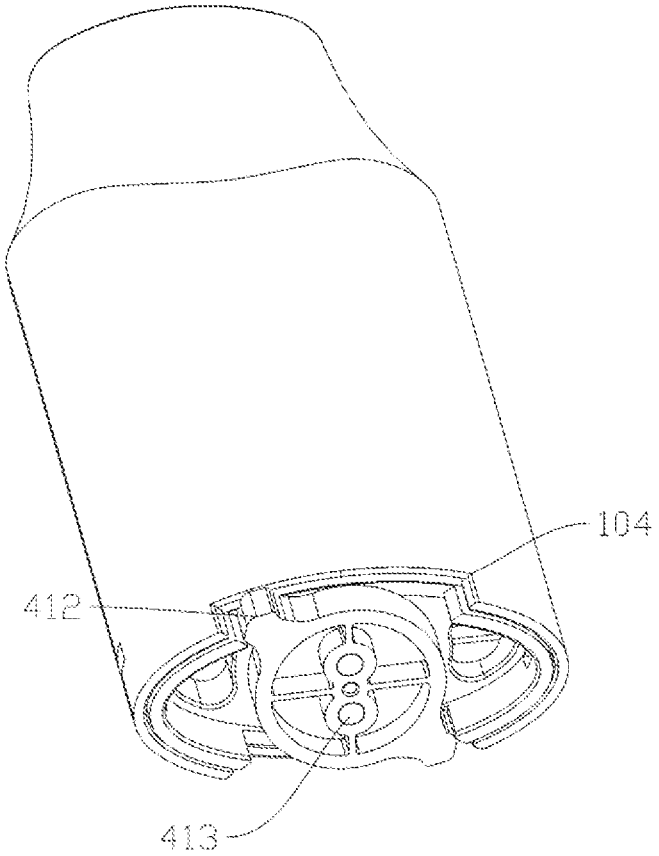
FIG. 24 is a schematic structural view of the vaporizer shown in FIG. 19 in a non-use state from another angle of view.

As shown in FIG. 12, the upper base body 42 may be in a columnar shape and be a hollow structure provided with a socket 423 on one end, the vaporization cavity 420 may be formed in the inner side of the upper base body 42, and the first air inlet hole 4111 may be in communication with the vaporization cavity 420. In some embodiments, the vaporization cavity 420 may not be limited to being arranged in the upper base body 42, and in some other embodiments, the vaporization cavity 420 may be arranged in the lower base body 41 alternatively. One end of the upper base body 42 that is close to the first air outlet hole 2111 is provided with a seal surface 425, and when the rotary support rotates to the second orientation relative to the vaporization base 20, the seal surface 425 may seal the first air outlet hole 2111. In some embodiments, the end of the upper base body 42 that is close to the first air outlet hole 2111 is provided with a sloping surface 421, and the sloping surface 421 abuts the seal surface 425 and slopes toward one side of the upper base body 42. By arranging the sloping surface 421, the area of the second air outlet hole 4211 can be increased, and the second air outlet hole 4211 can be easily dislocated from the first air outlet hole 2111, thereby achieving communication or disconnection of the air outlet channel. The rotary heating assembly 40 includes a second air outlet hole 4211, and the second air outlet hole 4211 may be provided on the sloping surface 421 and in communication with the vaporization cavity 420 to output the vapor formed by vaporization. In some embodiments, the upper base body 42 may be provided with a second liquid flowing hole 422. Specifically, the second liquid flowing hole 422 may be provided on two opposite side walls of the upper base body 42 and in communication with the vaporization cavity 420. The second liquid flowing hole 422 may be configured to convey the liquid vaporizable medium in the liquid storage cavity 103 to the heating structure 43. In some embodiments, a buckle hole 424 is provided on the upper base body 42, and the buckle hole 424 may be clamped with the clamping bone 4112 on the lower base body 41. In some embodiments, the upper base body 42 is provided with a limiting clamping opening 426, and the limiting clamping opening 426 is located on one end of the socket 423 and may be configured to match the bump 4113 on the lower base body 41 for limiting.

In some embodiments, the heating structure 43 may include a porous body 431 and a heating body. The porous body 431 is in a columnar shape. Specifically, the porous body 431 may be a cylindrical structure. The porous body 431 may be a ceramic porous body. Certainly, it can be understood that, in some other embodiments, the porous body 431 may be made of liquid absorbing cotton or other materials. In some embodiments, the porous body 431 is provided with a central through hole 4311 with two ends penetrated, one end may be in communication with the second air outlet hole 4211, and the other end may be in communication with the first air inlet hole 4111. Gas may enter the vaporization cavity 420 from the first air inlet hole 4111, then enter the central through hole 4311, and then carry the vapor formed by vaporization out of the second air outlet hole 4211. In some embodiments, the heating body is arranged in the porous body 431.

In some embodiments, the rotary heating assembly 40 further includes a conductive member 44, and two conductive members 44 may be provided. Specifically, the two conductive members 44 are mounted on the lower base body 41. Specifically, the two conductive members 44 may be mounted in one-to-one correspondence at the mounting holes 413 and extend to the heating structure 43 to be connected to the heating structure 43. In some embodiments, the conductive member 44 may be an ejector pin. Certainly, it can be understood that, in some other embodiments, the conductive member 44 may not be limited to the ejector pin.

Still as shown in FIG. 9 and FIG. 10, in some embodiments, the rotary heating assembly 40 further includes a first seal fixing member 45 and a second seal fixing member 46. The first seal fixing member 45 and the second seal fixing member 46 may be arranged in the vaporization cavity 420. The first seal fixing member 45 may be in a shape of a ring. In some embodiments, the first seal fixing member 45 may be a seal ring and may be arranged on one end of the heating structure 43 that is close to the second air outlet hole 4211. The outer diameter of the first seal fixing member 45 may be equivalent to the inner diameter of the upper base body 42, and the first seal fixing member 45 may be in an interference fit with the upper base body 42. The second seal fixing member 46 may be in a shape of a ring, and the second seal fixing member 46 is arranged on one end of the heating structure 43 that is away from the second air outlet hole 4211. Specifically, the second seal fixing member 46 may be located on the lower base body 41. The second seal fixing member 46 may be a seal ring with an outer diameter equivalent to the inner diameter of the upper base body 42 and may be in an interference fit with the upper base body 42.

Still as shown in FIG. 2 to FIG. 4, in some embodiments, the vaporization unit B further includes a seal circle 50, and the seal circle 50 is sleeved on the vaporization base 20. Specifically, the seal circle 50 may be an O-shaped circle and may be sleeved on the periphery of the base body 21, to connect the vaporization base 20 to the vaporization housing 100 in a sealing manner, thereby preventing the liquid vaporizable medium from leaking out of the vaporization housing 100.

In some embodiments, the electronic vaporization device further includes a seal ring sleeve C. The seal ring sleeve C may be made of seal silicone and may be sleeved on the periphery of the bump 223 of the sleeve portion 22, to connect the air outlet tube 102 to the sleeve portion 22 in a sealing manner, thereby preventing the liquid vaporizable medium from entering the first air outlet hole 2211.

As shown in FIG. 13 to FIG. 18, when the electronic vaporization device is in use, the pull portion 412 may be pulled to the rightmost side of the notch 104 to drive the entire rotary heating assembly 40 to rotate to the first orientation, and the rotary support is located in the first orientation relative to the vaporization base 20. In this case, the second air outlet hole 4211 is in communication with the third air outlet hole 3111, to be in communication with the first air outlet hole 2211 to form the air outlet channel. The first air inlet hole 4111 is in communication with the first air inlet channel 321 through the second air inlet hole 323 to form a second air inlet channel. The external gas may enter the first air inlet channel 321 from the air inlet column 121, then enter the vaporization cavity 420 through the first air inlet hole 4111, and enter the central through hole 4311 to carry the vapor formed after vaporization out of the second air outlet hole 4211, and the vapor may be outputted from the first air outlet hole 2211 through the third air outlet hole 3111. The second liquid flowing hole 422 is in communication with the third liquid flowing hole 312, to be in communication with the first liquid flowing hole 222 to form a liquid flowing channel. The liquid vaporizable medium in the liquid storage cavity 103 may enter the third liquid flowing hole 312 from the first liquid flowing hole 222 and then enter the porous body 431 from the second liquid flowing hole 422. The mounting hole 413 is in communication with the via hole 13, so that the electrode of the power supply assembly may be conductively connected to the conductive member 44, and the electronic vaporization device may be used normally.

As shown in FIG. 19 to FIG. 24, when the electronic vaporization device is not in use, the pull portion 412 may be pulled to the leftmost side of the notch 104 to drive the entire rotary heating assembly 40 to rotate to the second orientation, and the rotary support is located in the second orientation relative to the vaporization base 20. In this case, the second air outlet hole 4211 is dislocated from the third air outlet hole 3111, that is, the second air outlet hole 4211 is not in communication with the third air outlet hole 3111, so that the second air outlet hole 4211 is not in communication with the first air outlet hole 2211. If the first air inlet hole 4111 is dislocated from the first air inlet channel 321, that is, the first air inlet hole 4111 is not in communication with the first air inlet channel 321, the second air inlet channel and the air outlet channel are both disconnected, and the external gas cannot enter the upper base body 42 from the air outlet tube 102 and the first air inlet channel 321, thereby ensuring that the heating structure 43 is in a completely sealed state during transportation or placement and avoiding affecting the taste of the liquid vaporizable medium on the heating structure 43 after vaporization due to the heating structure 43 absorbing excessive moisture to deteriorate. If the second liquid flowing hole 422 is dislocated from the third liquid flowing hole 312, that is, the second liquid flowing hole 422 is dislocated from the first liquid flowing hole 222, the second liquid flowing hole 422 cannot be in communication with the first liquid flowing hole 222, the liquid flowing channel is disconnected, and the liquid vaporizable medium in the liquid storage cavity 103 cannot enter the rotary heating assembly 40, thereby avoiding liquid leakage and ensuring that the liquid vaporizable medium in the liquid storage cavity 103 does not deteriorate. If the mounting hole 413 is dislocated from the via hole 13, the electrode of the power supply assembly cannot be conductively connected to the conductive member 44 through the via hole 13, thereby ensuring that the heating structure 23 does not perform vaporization, to achieve a child lock function.

The electronic vaporization device has the following advantages by arranging the rotary heating assembly 40:

Before leaving the factory, the heating structure 43 can be sealed by rotation, and the liquid vaporizable medium in the liquid storage cavity 103 is also in a completely sealed state, thereby ensuring fresh liquid vaporizable medium and no oil leakage;

when the electronic vaporization device is not in use for a long time, the heating structure 43 is be closed by rotation, and the liquid vaporizable medium in the liquid storage cavity 103 and the heating structure 43 are in a sealed state and cannot absorb moisture in air, thereby ensuring that the taste of the vapor is consistent in next use; and the rotary heating assembly 40 further has a child lock function, and when heating structure 43 is closed, the ejector pin cannot be connected to the electrode of the power supply assembly, thereby avoiding misoperation by children.

In some other embodiments, the rotary support may not be rotatable, and the vaporization base 20 may be arranged rotatably. By rotating the vaporization base 20, the relative position of the rotary support and the vaporization base 20 can be changed, that is, the first liquid flowing hole 222 can be in communication with the second liquid flowing hole 422, the first air inlet hole 4111 can be in communication with the outside, and the first air outlet hole 2111 can be in communication with the second air outlet hole 4211, or the liquid flowing channel and the air outlet channel can be disconnected, and the first air inlet hole can be closed.

In some other embodiments, the seal structure may be omitted, that is, the rotary support can be directly sleeved on the periphery of the heating structure 43.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a vaporization base;

a rotary support; and a heating structure, wherein the rotary support is located in the vaporization base and rotatable relative to the vaporization base, wherein the vaporization base has a first liquid flowing hole and a first air outlet hole, wherein the rotary support has a vaporization cavity and a second liquid flowing hole, a first air inlet hole, and a second air outlet hole that are all in communication with the vaporization cavity, wherein the heating structure is fixed in the vaporization cavity, wherein, when the rotary support is located in a first orientation relative to the vaporization base, the first liquid flowing hole is in communication with the second liquid flowing hole to form a liquid flowing channel, the first air inlet hole is in communication with an outside, and the first air outlet hole is in communication with the second air outlet hole to form an air outlet channel, and wherein, when the rotary support rotates to a second orientation relative to the vaporization base, the liquid flowing channel and the air outlet channel are both disconnected, and the first air inlet hole is closed.

2. The vaporizer of claim 1, wherein the rotary support comprises a pull portion penetrating through the vaporization base.

3. The vaporizer of claim 2, wherein the rotary support comprises an upper base body and a lower base body, the upper base body is connected to the lower base body to form the vaporization cavity, and the lower base body comprises the pull portion.

4. The vaporizer of claim 1, wherein the rotary support comprises an upper base body and a lower base body, the upper base body is connected to the lower base body to form the vaporization cavity, the upper base body is provided with the second liquid flowing hole and the second air outlet hole, and the lower base body is provided with the first air inlet hole.

5. The vaporizer of claim 1, further comprising:

a seal structure located in the vaporization base, the seal structure being sleeved on the rotary support and provided with a third liquid flowing hole, a second air inlet hole, and a third air outlet hole, wherein the seal structure has the first air inlet channel, and the second air inlet hole is in communication with the outside through the first air inlet channel, and wherein, when the rotary support is located in the first orientation relative to the vaporization base, the first liquid flowing hole is in communication with the second liquid flowing hole through the third liquid flowing hole, the first air inlet hole is in communication with the first air inlet channel through the second air inlet hole, and the first air outlet hole is in communication with the second air outlet hole through the third air outlet hole.

6. The vaporizer of claim 5, further comprising:

a vaporization housing sleeved on the vaporization base, a liquid storage being is formed between the vaporization housing and the vaporization base, the liquid storage cavity being in communication with the first liquid flowing hole.

7. The vaporizer of claim 6, wherein the vaporization base is provided with a first vent hole in communication with the liquid storage cavity, and wherein the vaporization base has a vent channel, one end of the vent channel being in communication with the first vent hole, and an other end being in communication with the first air inlet channel.

8. The vaporizer of claim 7, wherein the seal structure has a second vent hole, the second vent hole being in communication with the first air inlet channel and the vent channel.

9. The vaporizer of claim 8, wherein the rotary support comprises an upper base body sleeved on the seal structure, and wherein one end of the upper base body close to the first air outlet hole comprises a seal surface, wherein, when the rotary support rotates to the second orientation relative to the vaporization base, the seal surface closes the first air outlet hole.

10. The vaporizer of claim 9, wherein the end of the upper base body close to the first air outlet hole comprises a sloping surface that abuts the seal surface and slopes toward a side of the upper base body, and wherein the second air outlet hole is provided on the sloping surface.

11. The vaporizer of claim 1, further comprising:

a conductive member; and a base, wherein the conductive member is mounted in the rotary support, and one end of the conductive member is connected to the heating structure, wherein a mounting hole is provided on the rotary support, and an other end of the conductive member is mounted at the mounting hole, wherein the base is connected to the vaporization base, and a via hole is provided on the base, wherein, when the rotary support is located in the first orientation relative to the vaporization base, the mounting hole is in communication with the via hole, and wherein, when the rotary support rotates to the second orientation relative to the vaporization base, the mounting hole is disconnected from the via hole.

12. The vaporizer of claim 2, further comprising:

a vaporization housing, wherein a notch is provided on a side wall of the vaporization housing, an avoidance opening is provided on the vaporization base, and the notch is provided corresponding to the avoidance opening for the pull portion to penetrate through.

13. An electronic vaporization device, comprising:

the vaporizer of claim 1.

* * * * *